United States Patent [19]

Lewis

[11] 4,368,801

[45] Jan. 18, 1983

[54] COLUMN CLIMBING DEVICE

[76] Inventor: Delmar D. Lewis, Rte #2, Letts, Iowa 52754

[21] Appl. No.: 241,797

[22] Filed: Mar. 9, 1981

[51] Int. Cl.[3] ..... A63B 27/04

[52] U.S. Cl. ..... 182/134; 182/221

[58] Field of Search ..... 182/133, 134, 135, 136, 182/221; 46/132; D21/242

[56] References Cited

U.S. PATENT DOCUMENTS

| | | | |
|---|---|---|---|
| 26,280 | 11/1859 | McNeely | 182/134 |
| 1,260,856 | 3/1918 | Bates | 182/134 |
| 1,312,399 | 8/1919 | Heywood | 182/134 |
| 1,632,688 | 6/1927 | Allahverdian | 182/134 |
| 3,111,194 | 11/1963 | Erwin | 182/134 |
| 3,121,471 | 2/1964 | Soderberg | 182/134 |
| 3,200,904 | 8/1965 | Weeks | 182/134 |
| 3,726,360 | 4/1973 | Price et al. | 182/134 |
| 3,867,998 | 2/1975 | Joseph | 182/221 |
| 4,153,139 | 5/1979 | Houch | 182/134 |
| 4,210,224 | 7/1980 | Kummerlin | 182/23 |

FOREIGN PATENT DOCUMENTS

| | | | |
|---|---|---|---|
| 351773 | 4/1922 | Fed. Rep. of Germany | 182/134 |
| 1101244 | 3/1961 | Fed. Rep. of Germany | 182/134 |
| 956813 | 2/1950 | France | 182/134 |
| 1146344 | 11/1957 | France | 182/134 |
| 1459316 | 10/1966 | France | 182/134 |
| 75837 | 12/1916 | Switzerland | 182/134 |

*Primary Examiner*—Reinaldo P. Machado
*Assistant Examiner*—Alvin Chin-Shue
*Attorney, Agent, or Firm*—Henderson & Sturm

[57] ABSTRACT

A climbing device for climbing columns such as girders having flanges. The devices are worn in pairs on the feet of the climber and each is equipped with a gripping member having spaced apart jaws adapted to grip the column flange. The gripping member on each device is mounted on the foot-attached or base member for selective swinging between two positions, one a climbing position in which each pair of jaws extends laterally inwardly of the respective foot and the other a retracted position in which the jaws extend laterally outwardly and behind the heel of the climber's foot so as to be out of the way when not used for climbing. Means is provided for selectively locking the gripping member to the base member in either of said positions.

6 Claims, 6 Drawing Figures

COLUMN CLIMBING DEVICE

BRIEF SUMMARY OF THE INVENTION

Many forms of devices, worn in pairs as attachments to the feet of climbers, are known in the art, the most common of which is the spike or gaff type worn by telephone linemen, for example. Devices of a generally similar character are also known, but modified to provide jaws for gripping the flanges of steel columns. The problem with the prior art column-climbing devices is that the jaws are rigidly attached to the foot attachable part and thus create problems for the wearer when he is not climbing; that is to say, the fixed jaws project either forwardly, as in the U.S. Patent to Heywood, U.S. Pat. No. 1,312,399, or laterally inwardly, as in U.S. Patent to Erwin, U.S. Pat. No. 3,111,194. According to the present invention, this problem is eliminated by providing each gripping member of such design and mounting on the foot-attachable part as to be changeable between a climbing position, in which the jaws project laterally inwardly so as to grip the column flange, and a retracted position in which the jaws project laterally outwardly behind the heel of the climber's foot and thus away from his other foot. With both grippers swung to retracted position, the wearer will find it much easier to walk, since the jaws will not interfere with each other. Means is provided for selectively locking the jaws in either position. The locking means is so designed as to require positive, manual release and thus is very unlikely to become unlocked accidentally. Other features and advantages of the invention will become apparent to those versed in the art as a preferred embodiment is disclosed in the ensuing description and accompany drawings.

DETAILED DESCRIPTION

Figure 1:
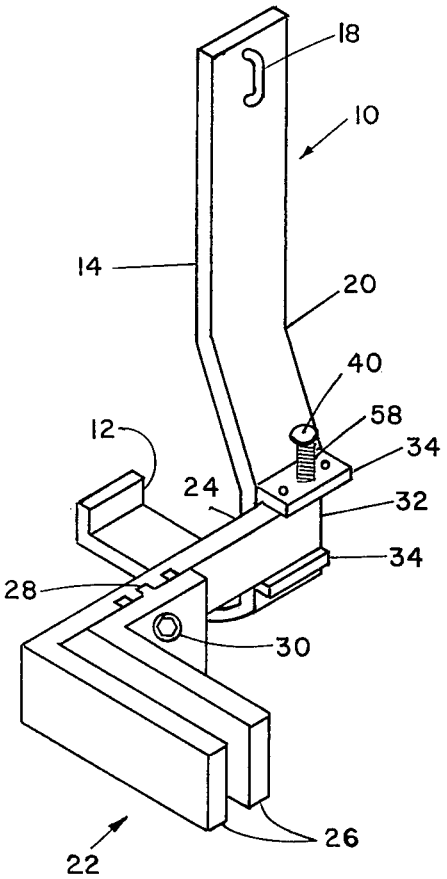
FIG. 1 is a perspective of one of a pair of devices according to the invention.
Figure 2:
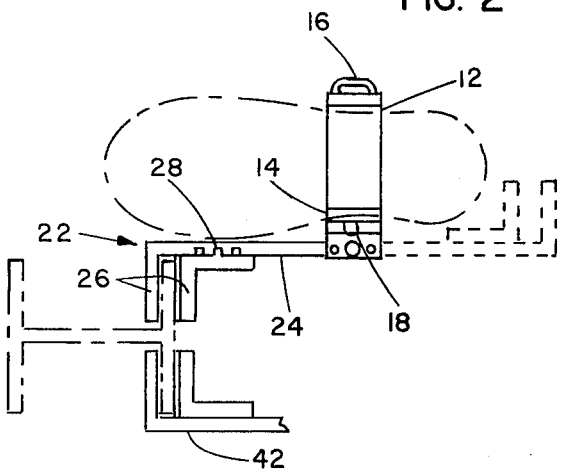
FIG. 2 is a plan of the device, showing a flanged column and climber's shoes in dot-dash lines and illustrating the climbing position of the gripping member (full lines) and the retracted position (dotted lines).
Figure 3:
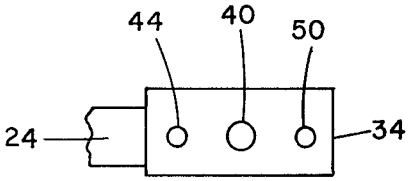
FIG. 3 is a partial plan view of the pivot and lock means.
Figure 4:
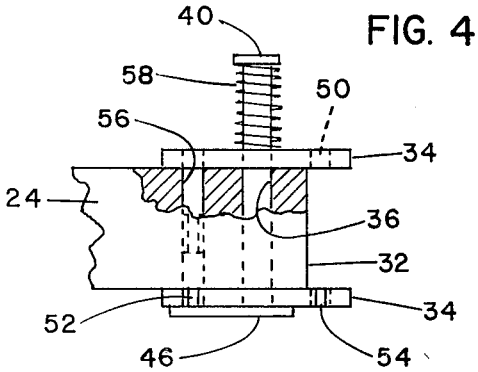
FIG. 4 is a side view of the same, partly in section.

A foot-attachable base member is designated in entirety at 10 and comprises a shoe-receivable stirrup 12 and an integral upright part 14 to be received along the inner side of the climber's leg. The stirrup has a welded-on loop 16 (FIG. 2) for receiving a strap (not shown) to secure the stirrup to the climber's foot. The upright part has a similar loop 18 for strapping to the climber's leg, preferably below the knee. The upright part has an offset 20 directed forwardly so as to clear the climber's ankle bone.

A gripping member 22 is formed generally as an *L*, having a first part or leg 24 adapted to lie alongside the climber's shoe and another part comprising a pair of jaws 26 spaced apart fore and aft as respects the length of the climber's shoe. One jaw is selectively adjustable relative to the first part 24, as indicated at 28, to accommodate flanges of different thicknesses. The adjustability is here shown as involving intermeshing teeth so as to better secure the adjusted position. The movable or adjustable jaw is preferably rigidly secured to the first part 24 by one or more Allen screws 30.

Figure 6:
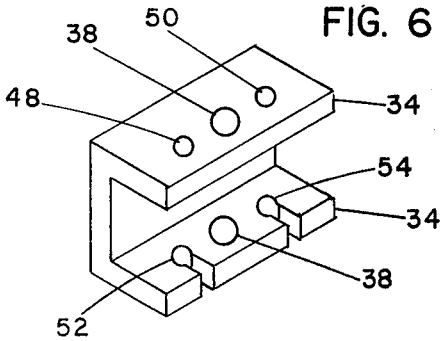
FIG. 6 is a perspective of the lug means for pivotally and lockably mounting the gripping member on the base member.

The first or longer part 24 of the gripping member has a free or rear end 32 (opposite to the end at which the jaws are located) and is mounted on the base member by mounting means including vertically spaced upper and lower lugs 34. These lugs may be welded or otherwise rigid with the base member and are vertically alined. The free end of the gripping member part has therein a vertical bore 36 coaxial with central bores 38 respectively in the lugs (FIG. 6). A pivot member 40 is passed through these alined bores and mounts the gripping member on the base member for selectively swinging between the climbing position (full lines, FIG. 2) and the retracted position (dotted lines, FIG. 2). In climbing position, the jaws extend laterally inwardly of the climber's foot for gripping the flange of a steel column, as indicated in dot-dash lines in FIG. 2. The jaws of a second device are indicated at 42 for the climber's left foot. Since the devices are mirror images of each other, both have not been shown in detail. In retracted position, the jaws extend laterally outwardly behind the heel of the climber's shoe (FIG. 2) and thus away from the jaws of the other device, which will have been also swung to retracted position, thus removing substantially all interference between the climber's feet when walking. It should be noted in passing that the jaws are arranged so they grip opposite edges of the same flange rather than opposed flanges. This is for the reason that the distance between opposed flanges varies widely and would cause the climber to spread his feet too wide for comfort. The other dimension (across opposed edges) does not often vary that much.

Figure 5:
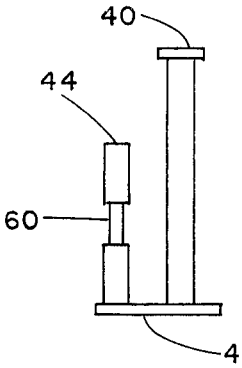
FIG. 5 is a view of the combined pivot and lock pin, omitting the spring.

Means is provided for selectively locking the gripping member in either of its positions. This means here takes the form of a locking pin 44 rigidly joined to the pivot member by a cross member 46, giving the combined pin and member a generally U shape (FIG. 5). From FIG. 6 especially, it will be seen that, in addition to the central bore 38, the upper lug has front and rear vertical bores 48 and 50, equi-distantly spaced front and rear respectively of the central bore. This spacing corresponds to that between the pivot member and locking pin. The lower lug has front and rear key-hole openings 52 and 54, respectively. These are alined respectively with the upper bores 48 and 50. Assume that the gripping member is in its climbing position and refer to FIGS. 3 through 6 especially: The pivot pin 40 is longer than the locking pin 44 and thus normally projects above the upper lug when the pivot member is received in the bores 36 and 38, the locking pin then being received by the lower front opening 52, a second bore 56 in the free end of the gripping member parallel to the first bore 36, and by the front bore 48 in the upper lug 34. Since the pivot member and locking pin are combined, they cannot move separately but must move as a unit. The upper end of the pivot member is headed and yieldable means in the form of a coiled compression spring 58 urges the unit upwardly. Downward movement is accomplished by manually depressing the headed pivot member. While the pivot member itself remains in its bores, the shorter locking pin retracts from the front bore of the upper lug, and an intermediate portion of the locking pin, at 60, is of reduced diameter so as to enable lateral escape of the locking pin outwardly from the front key-hole opening 52 in the lower lug. Meanwhile, of course, the upper part of the locking pin is still retained by the bore 56 in the gripping member and, as the gripping member is swung to its retracted position, the locking pin moves with it about the pivot member bore. When the retracted position is reached, the combined member-pin is depressed and the reduced portion lines up with the rear key-hole opening and the locking pin is thus alined with the key-hole opening 54 and the rear bore 50 in the upper lug.

It will be seen from the foregoing that the gripping means is securely and positively locked in either of its positions. The ability of the locking pin to pass through the free or rear end of the gripping means and into both upper and lower lugs materially increases the strength of the locking system. The pin and pivot member have relatively close sliding fits within their respective bores, eliminating undesirable looseness. The strength of the return spring is chosen on the basis of its ability to withstand accidental depression of the locking pin and pivot member. The basic ability of the gripping member to occupy either of two positions increase the flexibility of the device and significantly enhances its ease and convenience in use. Features and advantages other than those enumerated will readily occur to those versed in the art, all without departure from the spirit and scope of the invention.

I claim:

1. A climbing device of the class described, including a base member having means for the attachment to a climber's foot, a gripper member carried by the base member and having a pair of jaws spaced apart fore-and-aft as respects the length of the climber's foot for gripping the flange of a column, characterized in that the gripping member is L-shaped as seen from above, having a first part adapted to lie alongside the inner side of the climber's foot and a second part fixed to the first part and constituting the jaws, the first part has a free end opposite to the jaws and is mounted thereat on the base member by an upright pivot member for selective swinging between a climbing position in which the jaws extend laterally inwardly of the climber's foot for gripping a column flange and a retracted position in which the jaws extend laterally outwardly and behind the heel of the climber's foot, and means is provided for selectively securing the gripping member to the base member in either of said positions.

2. The device of claim 1, further characterized in that the last-named means comprises a locking element and spring-biased means for yieldably retaining the locking element in locking position.

3. The device of claim 1, further characterized in that the last-named means comprises a lug fixed to the base member and having a central upright bore and front and rear upright bores spaced equi-distantly respectively ahead of and behind the central bore, the free end of the first part of the gripper has an upright bore coaxial with the central bore for receiving the pivot member and a second upright bore disposed for vertical alinement, selectively, with either the front or rear bore, depending upon the position of the gripping member, and a locking pin is receivable selectively in either set of alined other bores.

4. The device of claim 3, further characterized in that the pivot member and locking pin are interconnected for vertical movement together in the respective alined bores, and are vertically movable in the respective bores to retract the locking pin from its lug bore so as to enable swinging of the gripping member, and means is provided for yieldably resisting the vertical movement of the locking pin and pivot.

5. The device of claim 4, further characterized in that a second lug is rigidly attached to the base member below the free end of the first part of the gripping member and in vertical alinement with the first lug, and the second lug has a central bore for receiving the pivot member.

6. The device of claim 5, further characterized in that the second lug has front and rear openings respectively alined with the front and rear bores in the first lug, the locking pin fits within the front and rear openings in addition to fitting the front and rear bores, according to the position of the gripping member, each of the openings is of key-hole shape opening laterally inwardly of the base member, and the locking pin has a reduced-diameter portion intermediate its ends to enable lateral escape of the locking pin from the respective opening when the locking pin and pivot member are moved vertically to retract the locking pin.

* * * * *